US007900788B2

(12) United States Patent
Gaillot et al.

(10) Patent No.: US 7,900,788 B2
(45) Date of Patent: Mar. 8, 2011

(54) SELF VENTING CLOSURE

(75) Inventors: Maxime Pierre Gaillot, Zaessingue (FR); Sebastien Cedric Widmer, Landser (FR); Philippe Gerard Odet, St. Georges de Reneins (FR)

(73) Assignee: Obrist Closures Switzerland GmbH, Reinach (CH)

( * ) Notice: Subject to any disclaimer, the term of this patent is extended or adjusted under 35 U.S.C. 154(b) by 946 days.

(21) Appl. No.: 11/718,847

(22) PCT Filed: Nov. 8, 2005

(86) PCT No.: PCT/EP2005/055807

§ 371 (c)(1),
(2), (4) Date: Jun. 4, 2007

(87) PCT Pub. No.: WO2006/051068

PCT Pub. Date: May 18, 2006

(65) Prior Publication Data

US 2008/0093328 A1 Apr. 24, 2008

(30) Foreign Application Priority Data

Nov. 11, 2004 (EP) ..... 04105712

(51) Int. Cl.
*B65D 51/16* (2006.01)

(52) U.S. Cl. ..... 215/260; 215/344; 215/DIG. 1

(58) Field of Classification Search ..... 215/260, 215/344, DIG. 1; 220/782
See application file for complete search history.

(56) References Cited

U.S. PATENT DOCUMENTS

| | | | | |
|---|---|---|---|---|
| 5,785,196 | A * | 7/1998 | Montgomery | 215/354 |
| 6,021,912 | A | 2/2000 | Hertrampf et al. | |
| 2001/0027957 | A1 | 10/2001 | Kano | |
| 2003/0173325 | A1 * | 9/2003 | Mavin | 215/270 |

FOREIGN PATENT DOCUMENTS

| | | |
|---|---|---|
| EP | 0575987 | 12/1993 |
| EP | 0858416 | 8/1999 |
| EP | 1327588 | 7/2003 |

* cited by examiner

*Primary Examiner*—Anthony Stashick
*Assistant Examiner*—James N Smalley
(74) *Attorney, Agent, or Firm*—Shoemaker and Mattare

(57) ABSTRACT

A closure 10 for a container, comprises a substantially circular base 20, a skirt 30 extending from the periphery thereof, a bore seal 50 in the form of an annulus and a rib 70 lying on the surface of the base 20 in a substantially radial direction and in contact with the radially inner surface of the bore seal 50 at one end for transferring any movement of the center of the base 20, relative to the skirt 30, to the bore seal 50 such that the bore seal 50 is pulled radially inward to allow venting of excess pressure within the container, wherein the end of the rib 70 in contact with the radially inner surface of the bore seal 50 is substantially thinner, in a plane parallel to the base 20, than the other end of the rib 70.

12 Claims, 3 Drawing Sheets

SELF VENTING CLOSURE

The present invention relates to a closure for a container wherein the closure will automatically self-vent if the pressure of gas within the container increases beyond a desired level.

One such closure is known from European Publication No. 0858416 A1. The known closure comprises a typical shell with a base and downwardly depending skirt defining the outside of the closure. Within the closure, a bore seal downwardly depends from the base. Radially between this bore seal and skirt a stop also downwardly depends from the base. This stop acts to prevent over-tightening of corresponding screw threads located within the shell and on an associated container, and acts against the rim of the container. Between the stop and the bore seal the thickness of the base is thinned.

Further, a rib of uniform thickness is provided with a cross-sectional shape being in the form of a right-angled triangle. One of the non-hypotenuse sides lies along the inside of the base and the other non-hypotenuse side lies along the bore seal. The hypotenuse side of the triangle does not lie on any other surface. The side of the rib which lies on the inside of the base extends from the bore seal towards the axial centre of the base. The side which lies on the bore seal does not extend the full height of the bore seal but rather only extends as far as the part of the bore seal which bulges radially outwardly. Thus the portion of the bore seal which has no rib lying against it, is permitted to be more flexible than the portion of the bore seal which is braced by the presence of the rib.

As pressure increases in a container, which may be due to any number of reasons such as fermentation, temperature increase etc., a closure, as described above, when screwed onto the container so as to seal the container, will "dome". This "doming" means that the centre of the base will rise upwards away from the container.

This increase in pressure is undesirable for several reasons. For instance, customers may be dissuaded from purchasing a product with a domed closure, and it may cause problems of a sudden release of pressure once the closure is opened, leading to the possibility of injury.

In use, as the closure domes, the rib will transmit the doming force from the centre of the closure to the bore seal. This force will pull the bore seal radially inwards. This has the effect that the seal formed between the bore seal and the container is broken allowing gas to exit from the container.

As the gas escapes, the pressure reduces in the container, thus causing the doming effect to be diminished and the closure base to return to its normal un-domed state. This moves the bore seal back to its sealing position.

During venting, the thinned portion of the base acts as a hinge allowing the portion of the base, including the part which has the bore seal depending from it, to move upwards.

One problem associated with this known closure is that because the stop seals against the rim of the container there is no defined route for the gas to escape from the container once the closure self-vents. This can reduce the effect of the self-venting.

Further, after moulding, as the closure cools, the rib can cause sink marks on the radially outer surface of the bore seal, due to the relative size of the rib, which can prevent the bore seal from sealing properly against the inside of the rim of the container. This is a major draw-back for aseptic products contained in an associated container since it is imperative that no air reaches the inside of the closure or container.

Further still, the bore seal is prevented from flexing sufficiently along its entire axial length to allow the closure to be easily fitted to the container after filling.

It is therefore an object of the present invention to provide a closure which overcomes these problems in particular which allows gas to vent past the stop, and self-venting of the container is possible without effecting either the sealability of the bore seal, or the ability to flex sufficiently to allow correct fitting of the closure to the container.

In one aspect, the invention provides a closure for a container, comprising a substantially circular base, a skirt extending from the periphery thereof, a bore seal in the form of an annulus and at least one rib lying on the surface of the base in a substantially radial direction and in contact with the radially inner surface of the bore seal at one end for transferring any movement of the centre of the base, relative to the skirt, to the bore seal such that the bore seal is pulled radially inward to allow venting of excess pressure within the container, wherein the end of the rib in contact with the radially inner surface of the bore seal is thinner, in a plane parallel to the base, than in a region spaced from the end of the rib in contact with the radially inner surface, in particular thinner than the other end of the rib. The end of the rib in contact with the inner surface is preferably substantially thinner, i.e. at least has a thickness of less than 80%, more preferably less than 50% of the thickness of the area spaced from the bore seal Since the end of the rib in contact with the bore seal is relatively thin it thus contacts the radially inner surface of the bore seal over a relatively small area. Accordingly, shrinkage of, and the presence of sink marks on, the bore seal is minimised. Further, by having the end of the rib which is in contact with the bore seal, being relatively thin the flexibility of the bore seal is not reduced. Further still, by having the end of the rib, opposite to the end in contact with the bore seal, being relatively thick the rib may efficiently transmit any force, due to doming, to the bore seal to allow venting. According to a preferred embodiment of the invention, the rib is asymmetrically arranged with respect to the axis of the closure. In particular one single rib or a plurality of non regularly spaced ribs will enhance the venting performance. By designing the dimension or thickness of the rib in the area where it is in contact with the bore seal, the pressure upon which the closure will start to vent can furthermore be adjusted. According to a further aspect of the invention, there is provided such a thinned region in order to adjust a desired venting pressure.

Further embodiments are disclosed in the dependent claims attached hereto.

Embodiments of the invention will now be described, by way of example, with reference to the following drawings in which.

Figure 4:
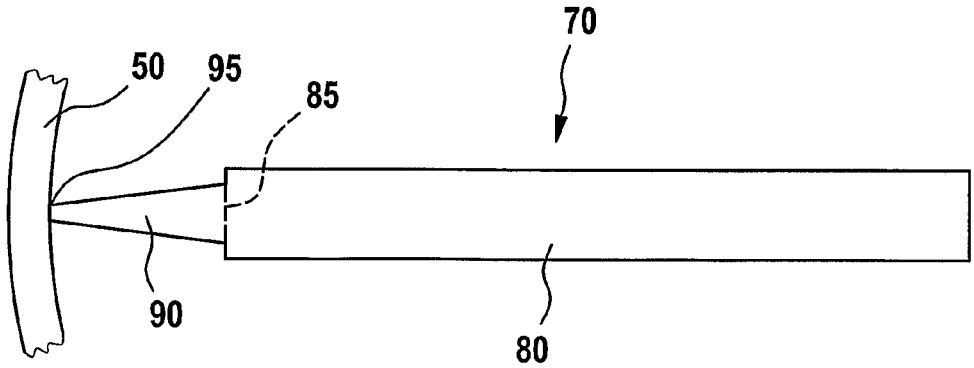
FIG. 4 shows a plan view of a second embodiment of the rib.
Figure 4A:
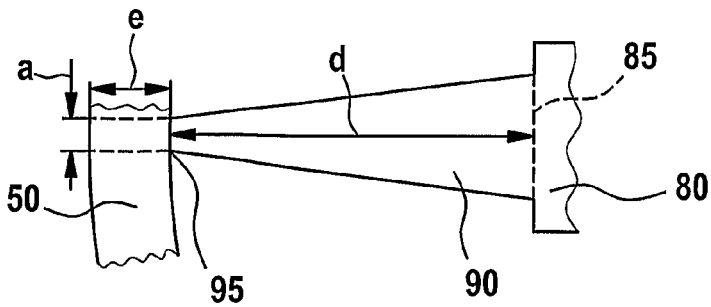

FIG. 4*a* shows an enlarged view of part of FIG. 4, and

Figure 5:
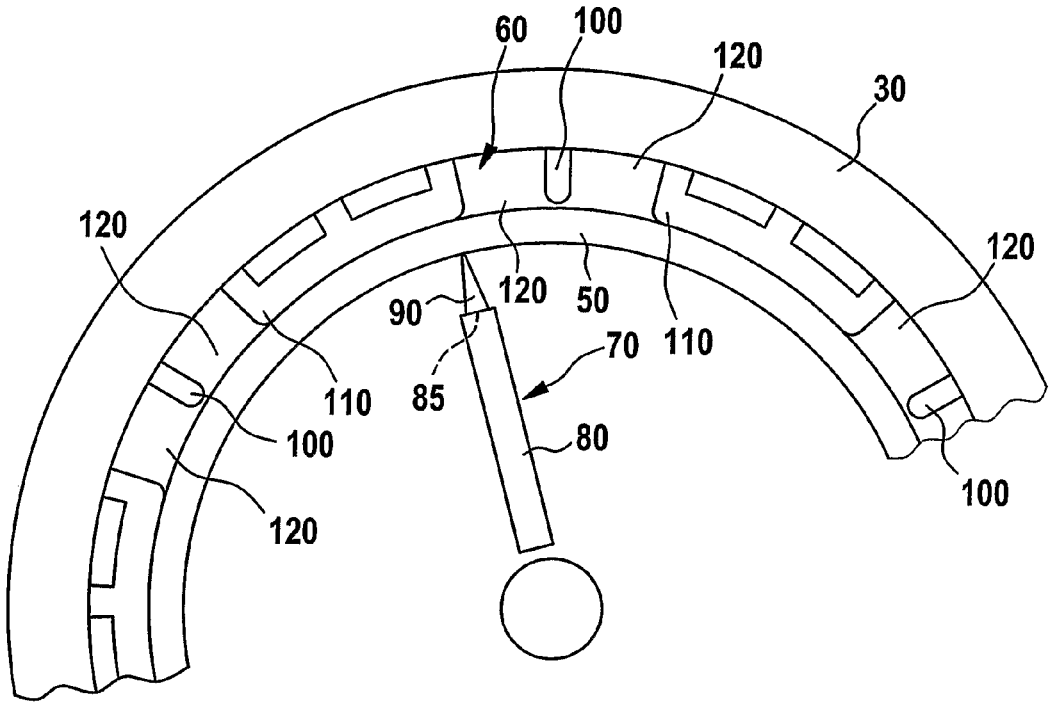

FIG. 5 shows a plan view of part of the base of the closure.

In the following description, all orientational terms, such as upper, lower, downwardly, radially and axially, are used in relation to the cross-sectional drawings shown in FIGS. 1 and 3 and should not be interpreted as limiting on the invention or its connection to a closure.

Figure 1:
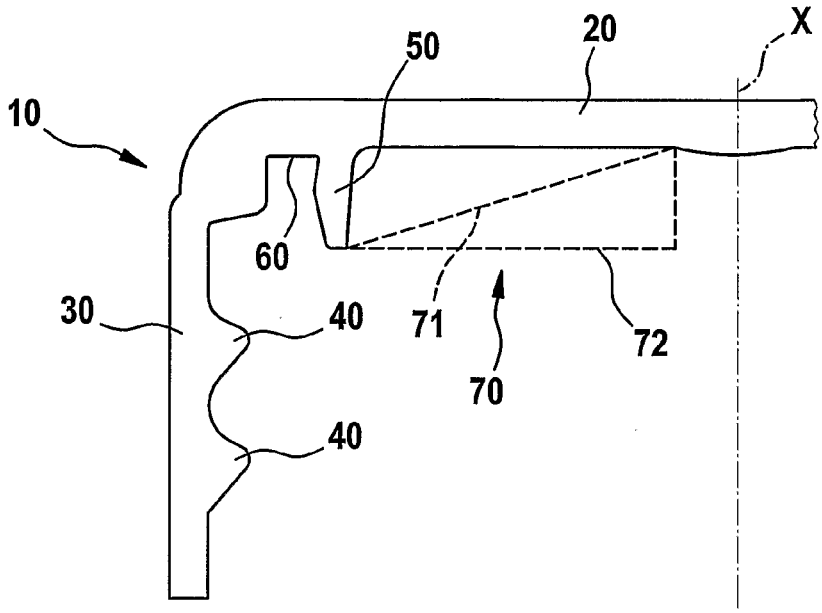
FIG. 1 shows a cross-sectional view of the closure.

In FIG. 1, only approximately half of the closure shell 10 is shown in cross-section since the closure is symmetrical, apart from the rib 70, about axis 'X'.

In this figure a base 20 may be seen. This base 20 is substantially circular in plan view (not shown). Depending downwardly from its periphery is a skirt 30. Located on the radially inner surface of this skirt 30 are screw threads 40. These screw threads co-operate with corresponding screw threads located on the radially outer surface of the neck of a container (not shown). However, although screw threads are shown it should be understood that the invention is not to be limited by this since other means of attachment of the closure to a container are of course possible. Such other means could be snap beads.

Also depending downwardly from the base 20 is a bore seal 50. This extends around the axis X in a complete annulus and provides a seal with the inside of the neck of the container (not shown) in the manner well understood to those skilled in the art.

Between the bore seal 50 and the skirt 30 a stop zone 60 is shown. This stop zone acts to limit the progress of the container towards the base 20 by acting on the rim of the container. This stop zone 60 will be described in more detail below.

Finally, two possible cross-sectional outlines of a rib 70 are generally indicated by lines 71 and 72. The outline referenced 71 is substantially triangular in cross-section. However, the outline referenced 72 is substantially rectangular. It would of course also be possibly to have many other shapes.

However, there are a few common features between these various possible shapes. One such common feature is that one end of the rib 70 lies against and in connection with the radially inner surface of the bore seal 50. In the figures, this connection extends over the full axial height of the inner surface of the bore seal 50. However, this may not always be the case.

Another common feature is that although in the figures the rib 70 is shown as extending from the bore seal along a line of radii to the approximate centre X of the closure, it may in fact only extend part of the way along a line of radii towards the centre.

Figure 2:
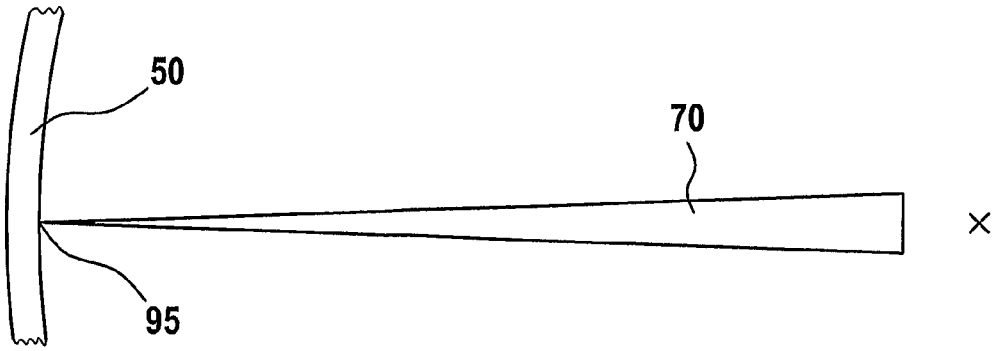
FIG. 2 shows a plan view of one embodiment of the rib.

In FIG. 2, a plan view of part of one embodiment of the closure is shown. The rib 70 extends along a line of radius between the centre X of the base 20 and the inner surface of the bore seal 50. It contacts the inner surface at a point referenced 95. Further, it may be seen that the end of the rib 70 which is in contact with the inner surface is relatively thinner than the opposite end. For the purposes of this description the word "end" refers not only to the very end but also to the length immediately preceding the very end. The overall appearance of the rib 70 in plan is substantially triangular. However, other shapes could be possible such as an isosceles trapezium.

The narrow end in contact with the surface eliminates the formation of sink marks on the outer surface of the bore seal. It also allows the bore seal to be flexible when the closure is applied to a container. Further, by having the other end relatively thicker, the forces generated by the doming of the cap may be efficiently transferred to the bore seal. If the end nearest the axial centre X of the closure also had a relatively thin dimension, there would be a risk that during doming of the closure the rib 70 would stretch on the side adjacent to the base 20 and compress on the opposite side such that the forces generated during doming would not be transferred to the bore seal and the container would not vent.

Figure 3:
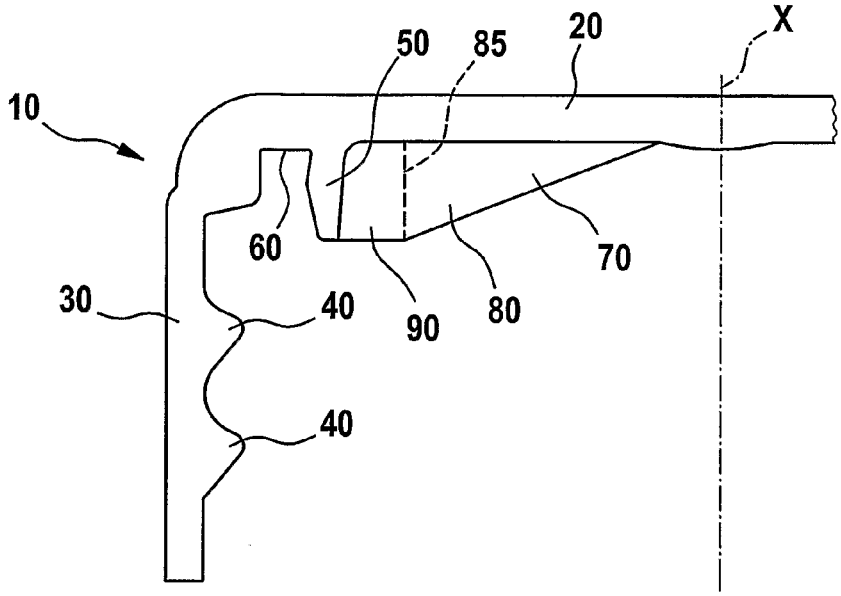
FIG. 3 shows another cross-sectional view of the closure.

In FIGS. 3, 4 and 5 a second embodiment is shown. In this second embodiment, the rib 70 is comprised of two parts. The first part 80 is substantially triangular in cross-sectional shape. It has a first surface lying in a radial direction on the underside of the base 20. Although in the figures the first part 80 is shown as extending from the bore seal along a line of radii to the approximate centre X of the closure, it may in fact only extend part of the way along a line of radii towards the centre. The surface 85 which is perpendicular to this first surface depends downwardly from the base 20 of the closure. The hypotenuse surface of the first part 70 is an open face not lying against any other surface.

The second part 90 of the rib 70 is approximately rectangular in cross-sectional shape and has one surface lying adjacent to the first part 80 along surface 85. The surface opposite this lies against the radially inner surface of the bore seal 50. Another side lies against the underside of the base 20 of the closure 10. This second part 90 lies in the same radial direction as the first part 80 such that the whole rib 70 lies in a straight line from approximately the centre of the base 20 to the bore seal 50.

In FIG. 4, the rib 70 is shown in plan. The first part 80 may be seen to be substantially rectangular and the second part 90 substantially triangular. However, the second part 90 may be rectangular or indeed be in the form of an isosceles trapezium.

The first part 80 and second part 90 meet at the junction 85. However, the widths of the two parts at this junction 85 may be different such that a step is formed between the two.

In one embodiment the apex of the triangular second part 90 lies against the radially inner surface of the bore seal 50. However, as described above, this apex could in fact be the end of a rectangle or an isosceles trapezium.

Since the portion of the second part 90 which lies against the bore seal is only relatively thin, it does not create sink marks on the opposite side of the bore seal and thus does not interfere with the bore seal sealing against the neck of the container. This is due to the property of plastic injection moulding in that freshly moulded plastic will shrink slightly on cooling, and that a larger body of plastic will shrink more than a smaller body. Therefore, by keeping the contact area between the bore seal and the rib to a minimum the effect of cooling will minimise any shrinkage of the bore seal and thus substantially eliminate the presence of sink marks thereon.

Further, since the second part 90 is relatively thin, it is relatively flexible too. This means that the bore seal may flex in the area of the rib in the same manner as if no rib was present. This means that the closure will be easily fitted to a container, wherein the bore seal will flex slightly, without any trouble.

Further still, the second part 90 may extend along the whole of the axial height of the bore seal 50. In this configuration, the force required to pull the bore seal 50 radially inwards is less than that required in a configuration where the rib 70 only extends partially along the axial height of the bore seal 50. Accordingly, the sensitivity of the self-venting feature is increased. However, since the second part 90 is relatively thin and therefore flexible the bore seal 50 is not stiffened in this area.

Finally, the first part 80 of the rib 70 is made more substantial than the second part 90 so that the doming effect is transferred to the bore seal efficiently as described above with regard to the first embodiment.

In FIG. 4, it may be seen that the thickness of the bore seal is defined as 'e'. This is the maximum thickness of the bore seal measured radially. Further, the circumferential width of the side of the second part 90 of rib 70 which adjoins the radially inner side of the bore seal 50 is defined as 'a'. Finally, the radial length of the second part 90 of rib 70 is defined as 'd'.

To ensure that the rib will permit venting of the container, that the bore seal is not stiffened by the rib's presence and that the radially outer surface of the bore seal is not effected by the presence of sink marks, it is necessary to determine precisely the dimensions of the rib 70 in relation to the radial thickness of the bore seal 50. It has been found that by using the following ranges, where 'a', 'd' and 'e' are defined as above, $$0.4(e)>a>0.3(e), \text{ and } 1.5(e)>d>e$$

this is achieved.

In FIG. 5, a portion of a closure 10 according to the invention is shown in plan view.

The first and second parts 80,90 of the rib 70 are visible, as is the bore seal 50.

Radially outward from the bore seal 50 is the skirt 30. Between these two 50,30 the stop zone 60 is located. This zone has several feet 100 provided therein. These feet 100 depend downwardly from the base 20 to a maximum depth as shown in FIG. 1 (indicated by reference '60').

The feet lie spaced apart about the circumference of the closure 10. Occasionally these feet 100 are linked together to form continuous feet 110. Where no feet 100,110 exist the base 20 will be slightly thinner. This is indicated by reference '120'. These sections 120 ensure that when the bore seal is pulled radially inwards, by the doming of the closure acting on the rib 70, there is a defined route for the gas to escape past between the top of the rim of the container and the underside of the base 20.

Although, the closure 10 has been described as having only one rib 70, it should be understood that more than one rib 70 could be provided.

The invention claimed is:

1. A closure for a container, said closure comprising a substantially circular base, a skirt extending from the periphery thereof, a bore seal in the form of an annulus and at least one rib lying on the surface of the base in a substantially radial direction and in contact with the radially inner surface of the bore seal at one end for transferring any movement of the center of the base, relative to the skirt, to the bore seal such that the bore seal is pulled radially inward to allow venting of excess pressure within the container, wherein, the end of the rib in contact with the radially inner surface of the bore seal is thinner, in a plane parallel to the base, than in an area of the rib spaced from the inner surface of the bore seal.

2. A closure according to claim 1, wherein the rib has a first part and a second part, the second part terminating at an end in contact with the base and the first part extending radially inwards from the other end of the second part.

3. A closure according to claim 2, wherein the first part of the rib is substantially stiffer than the second part.

4. A closure according to claim 2, wherein the second part of the rib is in the shape of an isosceles triangle in a plane parallel to the base of the closure.

5. A closure according to claim 2, wherein the second part is in contact with the whole of the axial length of the radially inner surface of the bore seal.

6. A closure according to claim 2 wherein the second part of the rib is in contact with the radially inner surface of the bore seal over a circumferential distance which lies in a range which is greater than or equal to 0.3 times the maximum radial width of the bore seal and less than or equal to 0.4 times the maximum radial width of the bore seal.

7. A closure according to claim 2 wherein the radial length of the second part of rib lies in a range which is greater than or equal to the maximum radial width of the bore seal and less than or equal to 1.5 times the maximum radial width of the bore seal.

8. A closure according to claim 2, further comprising a stop zone located radially between the skirt and the bore seal, said stop zone comprising feet separated by sections of reduced base thickness to allow a route for venting gas to escape from the container through the closure to the surrounding atmosphere.

9. A closure according to claim 8, wherein several feet are linked together to form a continuous foot.

10. A closure according to claim 1, wherein the at least one rib is asymmetrically arranged on the surface of the base.

11. A method for determining a venting pressure of a closure according to claim 1, wherein the thinning of said rib in an area in contact with the radially inner surface of the bore seal is selected in such a way as to set a predetermined venting pressure.

12. A container in combination with a closure, the closure comprising a substantially circular base, a skirt extending from the periphery thereof, a bore seal in the form of an annulus and at least one rib lying on the surface of the base in a substantially radial direction and in contact with the radially inner surface of the bore seal at one end for transferring any movement of the center of the base, relative to the skirt, to the bore seal such that the bore seal is pulled radially inward to allow venting of excess pressure within the container, wherein the end of the rib in contact with the radially inner surface of the bore seal is thinner, in a plane parallel to the base, than in an area of the rib arranged spaced from the inner surface of the bore seal.

* * * * *